US011378028B2

(12) United States Patent
Krach et al.

(10) Patent No.: US 11,378,028 B2
(45) Date of Patent: Jul. 5, 2022

(54) SYSTEM AND METHOD FOR DIAGNOSING CYLINDER DEACTIVATION

(71) Applicant: Ford Global Technologies, LLC, Dearborn, MI (US)

(72) Inventors: Adam Krach, Canton, MI (US); Michael Casedy, Ann Arbor, MI (US); Rommel Racelis, Ann Arbor, MI (US); Patrick Smithberger, Marine City, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 3 days.

(21) Appl. No.: 17/066,297

(22) Filed: Oct. 8, 2020

(65) Prior Publication Data

US 2022/0112851 A1 Apr. 14, 2022

(51) Int. Cl.
*F02D 41/00* (2006.01)
*F02D 13/06* (2006.01)
*F02D 17/02* (2006.01)

(52) U.S. Cl.
CPC ..... *F02D 41/0087* (2013.01); *F02D 13/06* (2013.01); *F02D 17/02* (2013.01)

(58) Field of Classification Search
CPC ..... F02D 41/0087; F02D 13/06; F02D 17/02
USPC ..... 123/481, 325, 198 F; 73/114.32–114.37, 73/118.2, 114.79
See application file for complete search history.

(56) References Cited

U.S. PATENT DOCUMENTS 5,070,846 A * 12/1991 Dudek ..... F02D 41/182 73/114.37
5,331,936 A * 7/1994 Messih ..... F02D 41/18 123/480
5,398,544 A * 3/1995 Lipinski ..... F02D 41/182 73/114.25
5,654,501 A * 8/1997 Grizzle ..... F02D 41/32 701/99
5,706,793 A 1/1998 Orzel et al.
5,714,673 A * 2/1998 Bidner ..... G01M 15/09 73/1.57
5,721,375 A * 2/1998 Bidner ..... F02D 41/0087 701/101
5,974,870 A * 11/1999 Treinies ..... F02D 41/0072 73/114.37
6,213,068 B1 * 4/2001 Hassdenteufel .... F02D 13/0226 73/114.25
6,273,039 B1 8/2001 Church
6,321,704 B1 11/2001 Church et al.
6,748,313 B2 * 6/2004 Li ..... F02D 41/18 73/114.32

(Continued)

FOREIGN PATENT DOCUMENTS

JP 2009024671 A * 2/2009

*Primary Examiner* — Sizo B Vilakazi
*Assistant Examiner* — Brian R Kirby
(74) *Attorney, Agent, or Firm* — Vincent Mastrogiacomo; McCoy Russell LLP

(57) ABSTRACT

Systems and methods for determining degradation of a cylinder deactivation mechanism are described. In one example, engine data generated while an engine is operation with all of its cylinders active is used to correct engine data generated while one or more engine cylinders are deactivated to improve detection of a degraded cylinder deactivation mechanism.

19 Claims, 5 Drawing Sheets

(56) References Cited

U.S. PATENT DOCUMENTS 6,776,134 B2 * 8/2004 Wildner ..... F02D 13/06 123/90.15
7,032,581 B2 * 4/2006 Gibson ..... F02D 41/008 123/673
7,072,758 B2 * 7/2006 Kolmanovsky ..... F01L 9/20 701/103
7,204,132 B2 * 4/2007 Reed ..... F02D 41/221 73/114.73
7,319,929 B1 * 1/2008 Davis ..... F02D 41/18 73/114.42
7,458,345 B2 12/2008 Winstead et al.
7,680,586 B2 * 3/2010 Ruth ..... G01M 15/05 123/681
7,680,686 B2 3/2010 Tellefsen et al.
7,762,237 B2 * 7/2010 Gibson ..... G01M 15/042 123/481
7,921,709 B2 * 4/2011 Doering ..... F02D 41/221 73/114.37
8,050,841 B2 * 11/2011 Costin ..... F02D 41/1497 701/84
8,286,471 B2 * 10/2012 Doering ..... F02D 41/0087 73/114.79
9,376,973 B2 * 6/2016 Brennan ..... F02D 41/0002
9,534,550 B2 * 1/2017 Matthews ..... F02P 5/045
9,670,854 B2 * 6/2017 Jankovic ..... F02D 41/0087
9,945,313 B2 * 4/2018 Kotwicki ..... F02D 41/18
10,100,761 B2 * 10/2018 Karnik ..... F02D 17/02
2002/0189576 A1 * 12/2002 Wildner ..... F02B 77/08 123/90.15
2003/0106524 A1 * 6/2003 Glugla ..... F02D 13/06 123/336
2003/0220732 A1 * 11/2003 Matthews ..... F02P 9/005 123/481
2006/0243040 A1 * 11/2006 Reed ..... F01L 9/20 73/114.79
2009/0306846 A1 * 12/2009 Jeong ..... F02D 41/22 702/183
2010/0154738 A1 * 6/2010 Tsukamoto ..... F02D 17/04 73/114.31
2010/0198486 A1 8/2010 Streib et al.
2010/0236521 A1 * 9/2010 Shiomi ..... F02D 37/02 123/406.23
2014/0251282 A1 * 9/2014 Kotwicki ..... F02D 41/18 123/481
2014/0303873 A1 10/2014 Glugla et al.
2014/0360477 A1 * 12/2014 Doering ..... F02D 41/0087 123/673
2016/0090926 A1 * 3/2016 Matsumoto ..... F02B 37/18 60/273
2016/0146139 A1 * 5/2016 Jankovic ..... F02B 75/02 123/406.12
2018/0363566 A1 * 12/2018 Banker ..... F02D 17/02
2019/0033170 A1 * 1/2019 Dudar ..... F02D 41/1445
2020/0309051 A1 * 10/2020 Kelly ..... F02D 41/1497
2021/0054793 A1 * 2/2021 Vogelsang ..... F02D 41/0002

* cited by examiner

SYSTEM AND METHOD FOR DIAGNOSING CYLINDER DEACTIVATION

FIELD

The present description relates to a system and methods for diagnosing operation of cylinder deactivation mechanisms. The system and methods may determine degradation of cylinder deactivating devices based on engine air charge estimates.

BACKGROUND AND SUMMARY

An engine may include one or more devices that deactivate intake valves and/or exhaust valves in a closed state so that one or more cylinders may be temporarily deactivated. By deactivating the one or more cylinders, the engine may operate in a variable displacement mode to reduce fuel consumption. For example, an eight cylinder engine may operate with four deactivated cylinders and four activated cylinders when driver demand torque is low. The engine may operate at a higher intake manifold pressure for a given engine speed and driver demand torque when four cylinders are deactivated as compared to if all eight cylinders were operated at the same given engine speed and driver demand torque. The higher intake manifold pressure allows the four active cylinders to generate the same torque as all eight cylinders at the given engine speed and driver demand torque. Increasing the intake manifold pressure reduces engine pumping losses, thereby increasing engine efficiency. However, it may be possible for a device that deactivates poppet valves of a cylinder to degrade such that intake and exhaust valves continue to operate while fuel flow to the cylinder is deactivated. Such a condition may cause excess air flow to catalysts in the engine's exhaust system, which may degrade emissions. Therefore, it may be desirable to provide a way of assessing whether or not degradation of a valve deactivation device has occurred.

The inventors herein have recognized the above-mentioned issues and have developed an engine control method, comprising: estimating an air charge of an engine according to data generated when one or more of an engine's cylinders are deactivated via a controller, where the air charge is adjusted according to an adaptive term determined from data generated when all of the engine's cylinders are activated; and adjusting engine operation according to the estimate.

By learning operating characteristics of an engine's cylinders while an engine is operating as is expected with all of its cylinders, it may be possible to provide the technical result of reducing false positive indications of degraded valve deactivators when one or more cylinders are commanded deactivated. In particular, it may be possible to reduce the influence of noise sources that may cause a control system to conclude that valve deactivators are degraded based on engine air charge or flow as determined from engine air-fuel ratio. In one example, the noise sources may include manifold absolute pressure (MAP) sensor signal offsets and errors in the determination of percentage ethanol included in gasoline.

The present description may provide several advantages. In particular, the approach may reduce false positive indications of valve deactivator degradation. Further, the approach may be provided without increasing system cost. In addition, the approach may be robust over a range of engine loads.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

The present description is related to improving detection of valve deactivating devices. The valve deactivating devices may hold intake and exhaust valves in closed positions throughout an engine cycle so that air does not flow through the engine via deactivated cylinders. The engine may be of the type shown in FIGS. 1-2B. The load that the engine is operating at may affect the engine's air-fuel ratio as shown in FIG. 3. The method of FIG. 4 may reduce influence of signal noise sources so that a more reliable assessment of valve deactivation devices may be provided. The method of FIG. 4 may provide an engine operating sequence as shown in FIG. 5 to assess whether or not a valve deactivating device is degraded.

Figure 1:
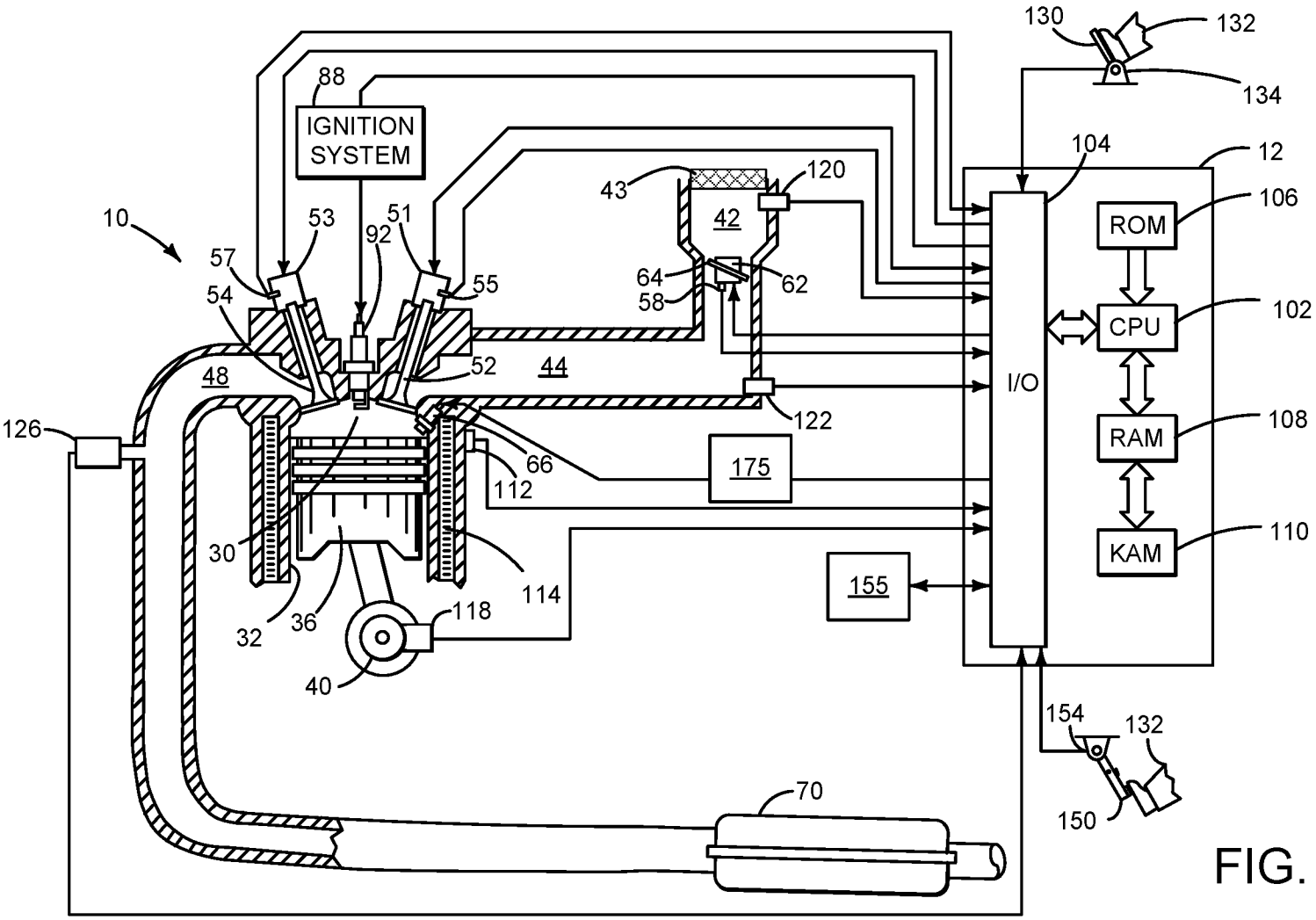
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40.

Combustion chamber 30 is shown communicating with intake manifold 44 and exhaust manifold 48 via respective intake valve 52 and exhaust valve 54. Each intake and exhaust valve may be operated by a variable intake valve operator 51 and a variable exhaust valve operator 53, which may be actuated mechanically, electrically, hydraulically, or by a combination of the same. For example, the valve actuators may be in a roller finger follower configuration or of the type described in U.S. Patent Publication 2014/0303873 and U.S. Pat. Nos. 6,321,704; 6,273,039; and 7,458,345, which are hereby fully incorporated for all intents and purposes. Intake valve operator 51 and an exhaust valve operator may open intake 52 and exhaust 54 valves synchronously or asynchronously with crankshaft 40. The position of intake valve 52 may be determined by intake valve position sensor 55. The position of exhaust valve 54 may be determined by exhaust valve position sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system 175. In addition, intake manifold 44 is shown communicating with optional electronic throttle 62 (e.g., a butterfly valve) which adjusts a position of throttle plate 64 to control air flow from air filter 43 and air intake 42 to intake manifold 44. Throttle 62 regulates air flow from air filter 43 in engine air intake 42 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an propulsive effort pedal 130 for sensing force applied by human driver 132; a measurement of engine manifold absolute pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when human driver 132 applies brake pedal 150; and a measurement of throttle position from sensor 58. Barometric pressure may also be sensed (sensor not shown) for processing by controller 12. Controller 12 may also receive input from and provide output to human/machine interface 155 (e.g., a touch display panel, pushbuttons, or other known human/machine interface). For example, human 132 may request that engine 10 be operated in an economy mode or a performance mode via human/machine interface 155. Alternatively, or in addition, controller 12 may provide vehicle status information, such as diagnostic indications and codes, human 132 via human/machine interface 155. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2A:
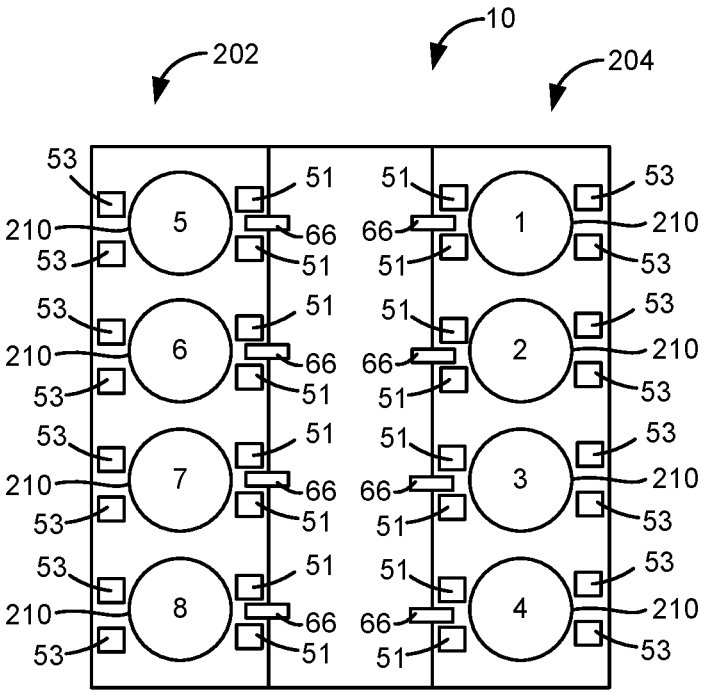
FIG. 2A is a schematic diagram of an eight cylinder engine with two cylinder banks.
Figure 3:
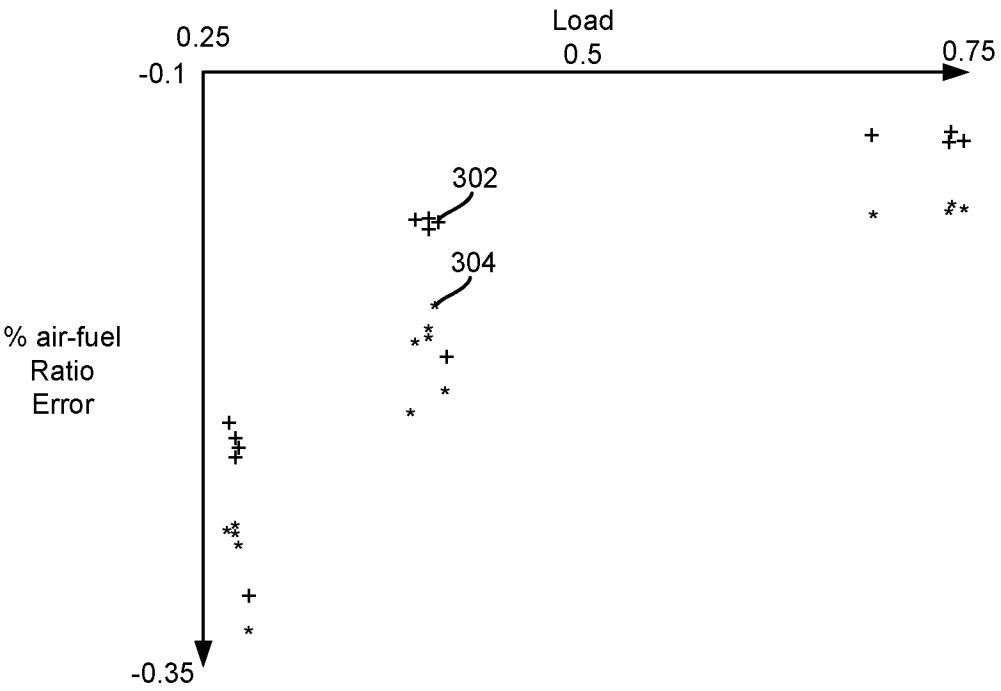
FIG. 3 is plot that shows air-fuel ratio error as a function of engine load.

Referring now to FIG. 2A, an example multi-cylinder engine that includes two cylinder banks is shown. The engine includes cylinders and associated components as shown in FIG. 1. Engine 10 includes eight cylinders 210. Each of the eight cylinders is numbered and the numbers of the cylinders are included within the cylinders. Fuel injectors 66 selectively supply fuel to each of the cylinders that are activated (e.g., combusting fuel during a cycle of the engine). Cylinders 1-8 may be selectively deactivated (e.g., not combusting fuel during a cycle of the engine) to improve engine fuel economy when less than the engine's full torque capacity is requested. For example, cylinders 2, 3, 5, and 8 (e.g., a fixed pattern of deactivated cylinders) may be deactivated during an engine cycle (e.g., two revolutions for a four stroke engine) and may be deactivated for a plurality of engine cycles while engine speed and load are constant or vary slightly. During a different engine cycle, a second fixed pattern of cylinders 1, 4, 6, and 7 may be deactivated for a plurality of engine cycles while engine speed and load are constant or vary slightly. Such cylinder deactivation modes may be referred to as static cylinder deactivation modes.

In addition, the engine cylinders may be operating such that other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. For example, cylinders 1, 3, 2, 6, 4, and 8 may fire and cylinders 5 and 7 may be deactivated in an engine cycle; cylinders 3, 7, 6, 5, and 8 may fire and cylinders 1, 2, and 6 may be deactivated in the next engine cycle; cylinders 1, 7, 2, 5, and 4 may fire and cylinders 2, 3 and 8 may be deactivated in a next engine cycle; then the activated cylinder and deactivated cylinder pattern may repeat. Such cylinder deactivation modes may be referred to as rolling cylinder deactivation modes.

Each cylinder includes variable intake valve operators 51 and variable exhaust valve operators 53. An engine cylinder may be deactivated by its variable intake valve operators 51 and variable exhaust valve operators holding intake and exhaust valves of the cylinder closed during an entire cycle of the cylinder. An engine cylinder may be activated by its variable intake valve operators 51 and variable exhaust valve operators 53 opening and closing intake and exhaust valves of the cylinder during a cycle of the cylinder. Engine 10 includes a first cylinder bank 204, which includes four cylinders 1, 2, 3, and 4. Engine 10 also includes a second cylinder bank 202, which includes four cylinders 5, 6, 7, and 8. Cylinders of each bank may be active or deactivated during a cycle of the engine.

Figure 2B:
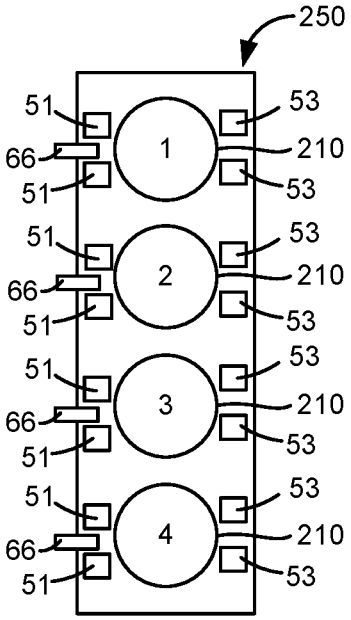
FIG. 2B is a schematic diagram of a four cylinder engine with a single cylinder bank.

Referring now to FIG. 2B, an example multi-cylinder engine that includes one cylinder banks is shown. The engine includes cylinders and associated components as shown in FIG. 1. Engine 10 includes four cylinders 210. Each of the four cylinders is numbered and the numbers of the cylinders are included within the cylinders. Fuel injectors 66 selectively supply fuel to each of the cylinders that are activated (e.g., combusting fuel during a cycle of the engine with intake and exhaust valves opening and closing during a cycle of the cylinder that is active). Cylinders 1-4 may be selectively deactivated (e.g., not combusting fuel during a cycle of the engine with intake and exhaust valves held closed over an entire cycle of the cylinder being deactivated) to improve engine fuel economy when less than the engine's full torque capacity is requested. For example, cylinders 2 and 3 (e.g., a fixed or static pattern of deactivated cylinders) may be deactivated during a plurality of engine cycles (e.g., two revolutions for a four stroke engine). During a different engine cycle, a second fixed pattern cylinders 1 and 4 may be deactivated over a plurality of engine cycles. Further, other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. In this way, the deactivated engine cylinders may rotate or change from one engine cycle to the next engine cycle.

Engine 10 includes a single cylinder bank 250, which includes four cylinders 1-4. Cylinders of the single bank may be active or deactivated during a cycle of the engine. Each cylinder includes variable intake valve operators 51 and variable exhaust valve operators 53. An engine cylinder may be deactivated by its variable intake valve operators 51 and variable exhaust valve operators holding intake and exhaust valves of the cylinder closed during a cycle of the cylinder. An engine cylinder may be activated by its variable intake valve operators 51 and variable exhaust valve operators 53 opening and closing intake and exhaust valves of the cylinder during a cycle of the cylinder.

Additionally, six cylinder engines may also be configured similarly to provide static and rolling variable displacement cylinder modes. The six cylinder engines may be of V or inline configurations.

The system of FIGS. 1-2B provides for an engine system, comprising: an engine including one or more poppet valve deactivating mechanisms; a controller including executable instructions stored in non-transitory memory that cause the controller to adjust operation of the engine when the one or more valve deactivating mechanisms is determined to be degraded according to a correction factor that is based on data generated while all cylinders of the engine were activated and an air charge estimate that is based on the correction factor. The engine system includes where degradation of the one or more valve deactivating mechanisms includes the one or more valve deactivating mechanisms not causing an intake or exhaust valve to cease opening during an engine cycle. The engine system includes where the engine air charge estimate is further based on an amount of fuel injected to the engine. The engine system further comprises an oxygen sensor, and where the engine air charge estimate is further based on output of the oxygen sensor. The engine system includes where adjusting operation of the engine includes activating all engine cylinders. The engine system further comprises additional instructions to generate a metric for determining degradation of the one or more valve deactivating mechanisms. The engine system includes where the metric is determined from a ratio. The engine system includes where the engine air charge estimate that is based on the correction factor is included in the ratio.

Referring now to FIG. 3, a plot of percent air-fuel ratio error versus engine load is shown. The plot is produced from data generated via a V8 engine operating with all of its cylinders (e.g., eight cylinders). The plot shows that engine air-fuel ratio error may be influenced by engine load.

The vertical axis represents percentage air-fuel ratio error and the magnitude of percentage air-fuel ratio error increases in the direction of the vertical axis arrow. The horizontal axis represents engine load and engine load increases in the direction of the horizontal axes arrow. The data points that are generated via a first bank of engine cylinders are indicated by + signs 302. Data points that are generated via a second bake of engine cylinders are indicated by * signs 304.

It may be observed that the percentage air-fuel ratio error increases at lighter engine loads and the percentage air-fuel ratio error decreases at higher engine loads. Consequently, it may be determined that engine load may influence engine air-fuel ratio values. Therefore, it may be desirable to correct air charge estimates as a function of, or based on, engine load.

Figure 4:
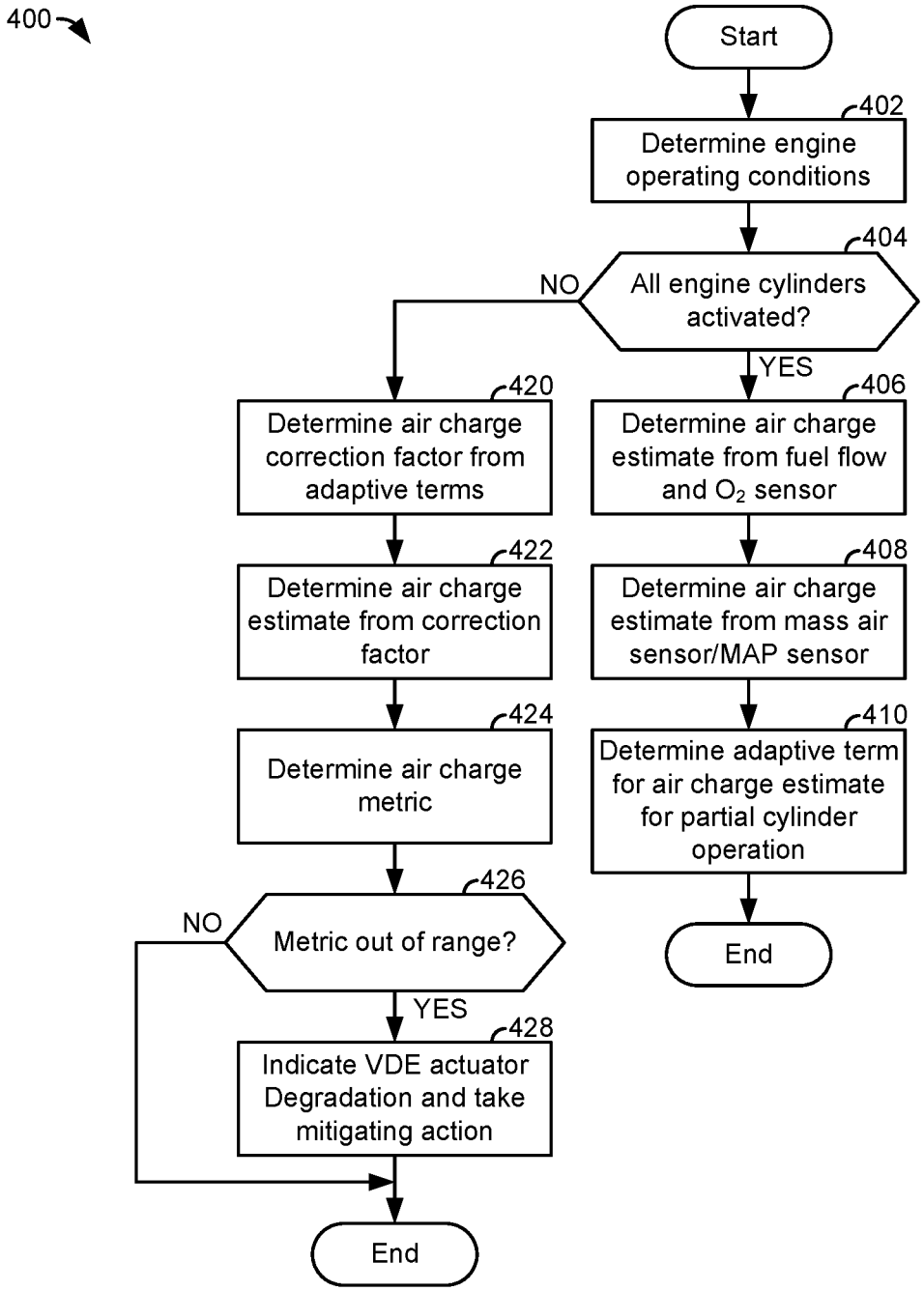
FIG. 4 shows a flow chart of an example method for operating an engine.
Figure 5:
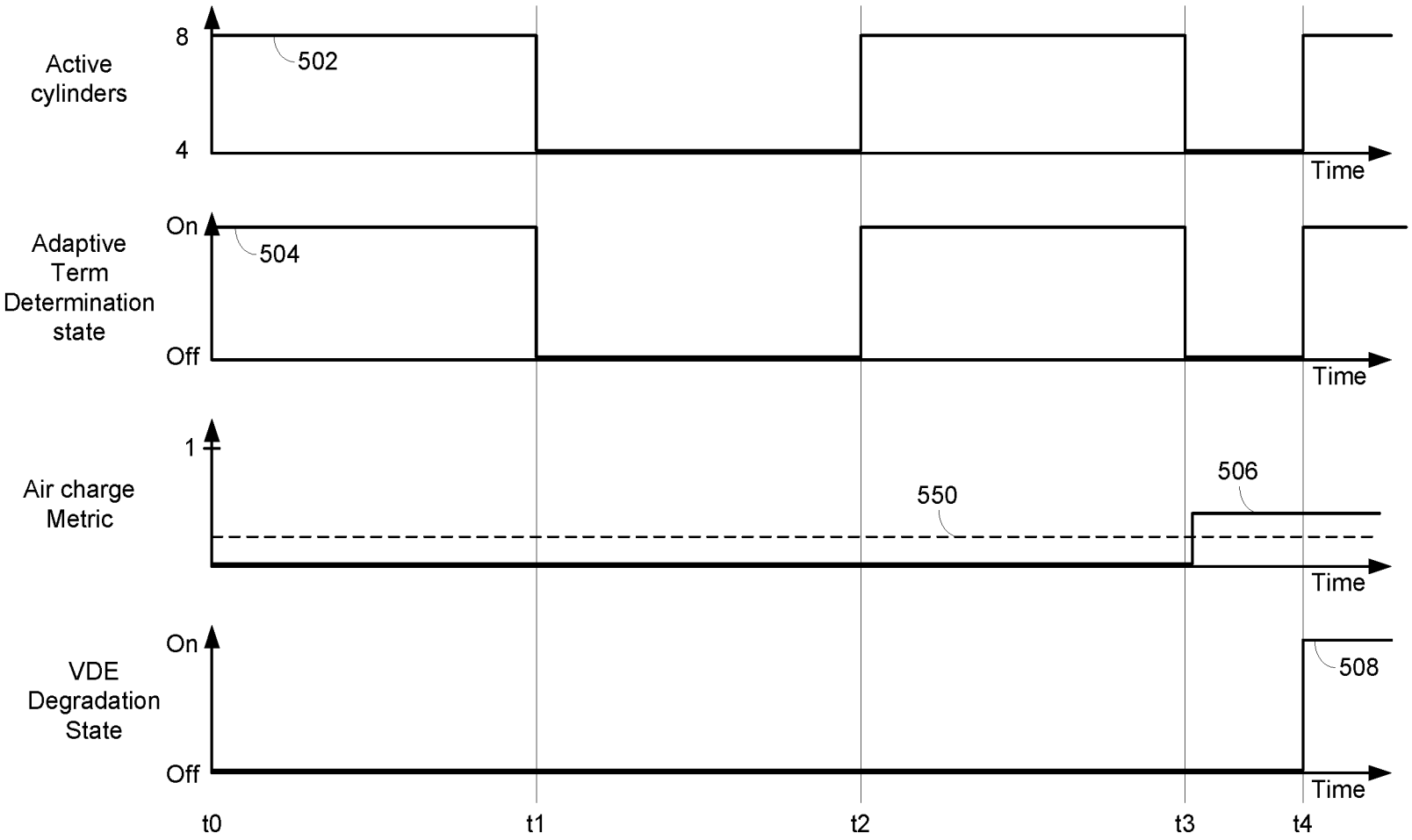
FIG. 5 shows an example engine operating sequence according to the method of FIG. 4.

Referring now to FIG. 4, a flow chart describing a method for operating an engine and diagnosing operation of cylinder deactivation devices is shown. The method of FIG. 4 may be incorporated into and may cooperate with the system of FIGS. 1-2B. Further, at least portions of the method of FIG. 4 may be incorporated as executable instructions stored in non-transitory memory while other portions of the method may be performed via a controller transforming operating states of devices and actuators in the physical world.

At 402, method 400 determines engine operating conditions. Engine operating conditions may include, but are not limited to engine speed, driver demand torque, engine temperature, barometric pressure, engine load, vehicle speed, ambient humidity, and ambient temperature. The engine operating conditions may be determined via the sensors and actuators described herein. Method 400 proceeds to 404.

At 404, method 400 judges if all of the engine's cylinders are activated. For example, if the engine is an eight cylinder engine and all eight of the engine's cylinders are activated, the answer is yes and method 400 proceeds to 406. Otherwise, if fewer than all of the engine's cylinders are activated, the answer is no and method 400 proceeds to 420. For example, if the engine is an eight cylinder engine and the engine is operating with four cylinders activated and four cylinders deactivated, then the answer is no and method 400 proceeds to 420. Method 400 proceeds to 406.

At 406, method 400 determines engine air charge estimate from engine fuel flow and oxygen sensor output. In one example, the engine air charge is determined via the following equation:

$$\text{air_chg_est}=(\Sigma\text{mfi})\times\text{lam}\times\text{afr_sto}\times(\text{num_banks})/(\text{Num_act_cyl})$$

where air_chg_est is the estimate of air flowing through the engine, mfi is mass of fuel injected to the cylinders of the cylinder bank being evaluated, lam is a lambda value (e.g., engine air-fuel ratio divided by the stoichiometric air-fuel ratio) based on output of the oxygen sensor, afr_sto is the stoichiometric air-fuel ratio for the fuel that is being combusted in the engine, num_banks is the number of cylinder banks in the engine, and num_act_cyl is the actual total number of cylinders of the engine that are presently activated. The variables mfi, lam, afr_sto, num_banks, num_act_ cyl are data determined via sensor outputs that are Method 400 proceeds to 408.

At 408, method 400 determines an engine air charge estimate based on output of a mass air flow (MAF) sensor or a MAP sensor. If the engine includes a MAF sensor, method 400 may determine the engine air charge for a cylinder bank as described in U.S. Pat. No. 5,331,936, which is fully incorporated by reference for all intents and purposes. On the other hand, if the engine air flow is determined via a MAP sensor, method 400 may determine the engine air flow via the following speed/density equation:

$$\text{air_cyl_air_chg_total}=\eta_v\cdot\frac{n_e}{2}\cdot V_d\cdot\frac{p}{RT}$$

where air_cyl_air_chg_total is the mass of air flowing through the engine, $n_y$ is the engine volumetric efficiency, $n_e$ is engine speed, $V_d$ is volume of all engine cylinders, p is intake manifold pressure, R is gas constant, and T is intake manifold temperature. The variables air_cyl_air_total, $V_d$, $n_e$, p, R, T, and $\eta_v$ are data determined from sensor outputs and values stored in controller non-volatile memory. Method 400 proceeds to 410.

At 410, method 400 determines an adaptive term for adjusting engine air flow when less than all of the engine's cylinders are activated. The adaptive term may be determined via the following equation:

$$\text{adaptive_term_tmp}=\frac{\text{air_chg_est}}{\text{air_cyl_air_chg_total}}$$

where adaptive_term_tmp is the adaptive data term, air_chg_est is the previously described estimate of air flowing through the engine, and air_cyl_air_chg_total is the previously described air flow through the engine. The adaptive term is stored in volatile memory in an array of n data points, where n is an integer number, according to the following equation:

$$\text{adaptive_term(load_idx)}=\text{rolav(adaptive_term(load), adaptive_term_tmp,rolave_tc)}$$

where adaptive_term is an array of adaptive data terms, load_idx is an engine load index value that is used to index or reference the array of adaptive data terms, rolav is an function that averages arguments adaptive_term(load) and adaptive_term_tmp via applying the time constant rolave_tc, and load is engine load. Method 400 proceeds to exit.

At 420, method 400 determines an engine air charge correction factor from an adaptive term that was previously determined when the engine operated with all of its cylinders active at 410. The engine air charge correction factor may be determined via the following equation:

$$\text{correction_factor}=\text{interp(adaptive_term(load_idx), adaptive_term(load_idx+1),cur_load)}$$

where correction_factor is correction factor data, interp is a function that interpolates between adaptive terms load_idx and load_idx+1, and cur_load is the present engine load. Thus, the correction factor is interpolated data that is based on two nearest adaptive term values. The correction factor may compensate for MAP and percent ethanol adjustment factor offsets that may influence determination of engine air flow amounts. Method 400 proceeds to 422.

At 422, method 400 determines an engine air charge estimate applying the correction factor. The engine air charge estimate may be determined via the following equation:

$$\text{air_charge_est_new}=\frac{(\sum mfi)\times lam\times\text{afr_sto}\times\frac{(\text{num_banks})}{(\text{Num_act_cyl})}}{\text{correction_factor}}$$

where air_charge_est_new is the air flow though the engine data and where the other parameters are as previously described. Method 400 proceeds to 424.

At 424, method 400 determines the engine air flow metric. The engine air flow metric is a percentage error value for the engine air flow. The engine air flow metric may be determined via the following equation:

$$\text{metric}=(\text{air_charge_est_new}-\text{air_cyl_air_chg_total})/\text{air_cyl_air_chg_total}$$

where metric is the engine air flow metric, which is a percentage of engine air flow as determined via an engine air flow sensor. Method 400 proceeds to 426.

At 426, method 400 judges if the engine air flow metric is out of a predetermined range of values. In one example, method 400 may judge if the absolute value of metric is greater than a predetermined value (e.g., 0.25). If so, the answer is yes and method 400 proceeds to 428. Otherwise, the answer is no and method 400 proceeds to exit.

At 428, method 400 indicates that one or more poppet valve deactivators is degraded. In addition, method 400 takes mitigating action in response to the indication of poppet valve deactivator degradation (e.g., operation of a poppet valve deactivator that does not deactivate a poppet valve that is requested to be deactivated). In one example, the mitigating action may include preventing deactivation of one or more engine cylinders. For example, if intake valves of cylinder number three of an eight cylinder engine are determined to not be deactivated after being commanded deactivated, method 400 may operate the engine with all engine cylinders activated. Method 400 proceeds to exit.

In this way, adaptive terms based on operating an engine with all engine cylinders activated may be a basis for determining engine air flow when less than all engine cylinders are activated. In addition, the adaptive terms may allow a controller to determine whether or not cylinder deactivating devices are degraded or operating as expected.

Thus, method 400 provides for an engine control method, comprising: estimating an air charge of an engine according to data generated when one or more of an engine's cylinders are commanded deactivated via a controller, where the air charge is adjusted according to an adaptive term determined from data generated when all of the engine's cylinders are activated; and adjusting engine operation according to the estimate. The method includes where the adaptive term is determined from two air charge estimates. The method includes where the two air charge estimates include a first air charge that is based on an amount of fuel that is injected to the engine, and where the second of the two air charge estimates is a second air charge that is based on output of an air sensing device. The method includes where adjusting engine operation included preventing deactivation of one or more cylinders. The method includes where the one or more of the engine's cylinders are deactivated via ceasing to supply fuel to the one or more cylinders. The method includes where the data includes an amount of fuel injected to the engine. The method includes where the data includes a lambda value as determined from output of an oxygen sensor.

Method 400 also provides for an engine control method, comprising: adjusting engine operation according to a metric comprising a ratio of engine air charge values, where the ratio of engine air charge values includes a numerator that is based on a difference of two engine air charge values and a denominator that is one of the two engine air charge values. The method includes where one of the two engine air charge values is based on an amount of fuel injected to an engine and output of an oxygen sensor. The method includes where the other of the two engine air charge values is based on output of an air charge sensor. The method includes where the one of the two air charge values is adjusted via a correction factor. The method includes where the correction factor that is based on data generated when all cylinders of an engine are activated.

Referring now to FIG. 5, an engine operating sequence according to the method of FIG. 4 is shown. The sequence of FIG. 5 may be provided via the system of FIGS. 1-2B. The present example may be performed at a constant engine speed and constant engine load. In this example, the engine includes a total of eight cylinders, four of which may be selectively deactivated based on vehicle operating conditions.

The first plot from the top of FIG. 5 is a plot of the actual total number of active cylinders versus time. The vertical axis represents the actual total number of active cylinders and the actual total number of active cylinders is indicated along the vertical axis. The horizontal axis represents time and time increases from the left side of the figure to the right side of the figure. Trace 502 represents the actual total number of presently active cylinders.

The second plot from the top of FIG. 5 is a plot of adaptive term determination state versus time. The vertical axis represents the adaptive term determination state and the adaptive term is being determined when trace 504 is at a higher level near the vertical axis arrow. The adaptive term is not being determined when trace 504 is near the horizontal axis. The horizontal axis represents time and time increases from the left side of the figure to the right side of the figure. Trace 504 represents the adaptive term determination state.

The third plot from the top of FIG. 5 is a plot of an engine air charge metric versus time. The vertical axis represents the engine air charge metric and the engine air charge metric value increases in the direction of the vertical axis arrow. The engine air charge metric is zero at the level of the horizontal axis. The horizontal axis represents time and time increases from the left side of the figure to the right side of the figure. Trace 506 represents the air charge metric value. Line 550 represents a threshold metric value. Cylinder valve deactivator degradation may be indicated when the engine air charge metric is greater than threshold 550.

The fourth plot from the top of FIG. 5 is a plot of valve deactivation device degradation state versus time. The vertical axis represents the valve deactivation device degradation state and the valve deactivation device is indicated as degraded when trace 508 is at a higher level near the vertical axis arrow. The valve deactivation device is determined to not be degraded when trace 508 is near the horizontal axis. The horizontal axis represents time and time increases from the left side of the figure to the right side of the figure. Trace 508 represents the valve deactivation device degradation state.

At time t0, the engine is operating with all eight cylinders activated and the adaptive term is being determined. The engine air charge metric is not being determined and the variable displacement engine (VDE) degradation state is not indicated.

At time t1, the engine switches from operating with eight cylinders to operating with four active cylinders. The four engine cylinders may be deactivated when catalyst temperature (not shown) reaches a threshold temperature, the engine has operated at the present speed and load with all eight cylinders for a predetermined amount of time, or when another condition is satisfied. The adaptive term is not being determined and the air charge metric is determined and its value is equal to zero. Therefore, the estimated engine air charge as determined via an amount of fuel injected to the engine and output of an oxygen sensor is in agreement with the engine air charge as determined from the air sensor. Accordingly, valve deactivating device degradation is not indicated.

At time t2, the engine is switched from operating with four cylinders back to operating with eight cylinders. The engine may be switched back to operating with eight cylinders after operating with four cylinders for a predetermined amount of time, catalyst temperature, or other condition. The adaptive term begins to be determined again and the air charge metric is not being determined. Valve deactivating device degradation is not indicated.

At time t3, the engine switches from operating with eight cylinders to operating with four active cylinders again. The adaptive term is not being determined and the air charge metric is determined and its value is equal to zero. Therefore, the estimated engine air charge as determined via an amount of fuel injected to the engine and output of an oxygen sensor is in agreement with the engine air charge as determined from the air sensor. Accordingly, valve deactivating device degradation is not indicated. However, shortly after time t3, the air charge metric value increases above threshold 550 to indicate a difference between the engine air charge as determined via the air sensor and engine air charge as determined from fuel flow to the engine and oxygen sensor output data.

At time t4, valve deactivating device degradation is indicated and the engine is switched back to operating all eight cylinders in response to the valve deactivating device degradation indication. The adaptive term is determined once again and the engine air charge metric remains at an elevated level.

In this way, an engine air charge metric based on two different engine air charge estimation calculations may be a basis for determining valve deactivating device degradation. In addition, when valve deactivating device degradation is indicated, mitigating actions may be taken so that excess air flow is not delivered to a catalyst so that engine emissions may be at desired levels.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine control method, comprising:

estimating an air charge of an engine according to data generated when one or more of an engine's cylinders are commanded deactivated via a controller, where the air charge is adjusted according to an adaptive term determined from data generated when all of the engine's cylinders are activated, where the data includes an amount of fuel injected to the engine; and adjusting engine operation according to the estimate.

2. The method of claim 1, where the adaptive term is determined from two air charge estimates.

3. The method of claim 2, where the two air charge estimates include a first air charge that is based on an amount of fuel that is injected to the engine, and where a second of the two air charge estimates is a second air charge that is based on output of an air sensing device.

4. The method of claim 1, where adjusting engine operation includes preventing deactivation of one or more cylinders.

5. The method of claim 1, where the one or more of the engine's cylinders are commanded deactivated via ceasing to supply fuel to the one or more of the engine's cylinders.

6. The method of claim 1, where the data includes a lambda value as determined from output of an oxygen sensor.

7. An engine system, comprising:

an engine including one or more valve deactivating mechanisms;

a controller including executable instructions stored in non-transitory memory that cause the controller to adjust operation of the engine when the one or more valve deactivating mechanisms is determined to be degraded according to a correction factor that is based on data generated while all cylinders of the engine were activated and an engine air charge estimate that is based on the correction factor.

8. The engine system of claim 7, where degradation of the one or more valve deactivating mechanisms includes the one or more valve deactivating mechanisms not causing an intake or exhaust valve to cease opening during an engine cycle.

9. The engine system of claim 7, where the engine air charge estimate is further based on an amount of fuel injected to the engine.

10. The engine system of claim 9, further comprising an oxygen sensor, and where the engine air charge estimate is further based on output of the oxygen sensor.

11. The engine system of claim 7, where adjusting operation of the engine includes activating all engine cylinders.

12. The engine system of claim 7, further comprising additional instructions to generate a metric for determining degradation of the one or more valve deactivating mechanisms.

13. The engine system of claim 12, where the metric is determined from a ratio.

14. The engine system of claim 13, where the engine air charge estimate that is based on the correction factor is included in the ratio.

15. An engine control method, comprising:

adjusting engine operation according to a metric comprising a ratio of engine air charge values, where the ratio of engine air charge values includes a numerator that is based on a difference of two engine air charge values and a denominator that is one of the two engine air charge values.

16. The method of claim 15, where one of the two engine air charge values is based on an amount of fuel injected to an engine and output of an oxygen sensor.

17. The method of claim 16, where the other of the two engine air charge values is based on output of an air charge sensor.

18. The method of claim 17, where the one of the two engine air charge values is adjusted via a correction factor.

19. The method of claim 18, where the correction factor is based on data generated when all cylinders of an engine are activated.

* * * * *